US010378313B2

(12) United States Patent
Dorban et al.

(10) Patent No.: US 10,378,313 B2
(45) Date of Patent: Aug. 13, 2019

(54) DOWNHOLE SHIFTING TOOL

(71) Applicant: Schlumberger Technology Corporation, Sugar Land, TX (US)

(72) Inventors: Andrew Dorban, Rosharon, TX (US); Michael Huh, Pearland, TX (US); Seth Alan Conaway, Houston, TX (US)

(73) Assignee: SCHLUMBERGER TECHNOLOGY CORPORATION, Sugar Land ( * ) Notice: Subject to any disclaimer, the term of this patent is extended or adjusted under 35 U.S.C. 154(b) by 317 days.

(21) Appl. No.: 15/199,151

(22) Filed: Jun. 30, 2016

(65) Prior Publication Data

US 2018/0003005 A1 Jan. 4, 2018

(51) Int. Cl.

| | |
|---|---|
| ***E21B 34/14*** | (2006.01) |
| ***E21B 31/00*** | (2006.01) |
| ***E21B 31/20*** | (2006.01) |
| *E21B 34/00* | (2006.01) |

(52) U.S. Cl.

CPC ..... *E21B 34/14* (2013.01); *E21B 31/00* (2013.01); *E21B 31/20* (2013.01); *E21B 2034/007* (2013.01)

(58) Field of Classification Search

CPC .... E21B 34/14; E21B 43/26; E21B 2034/007; E21B 23/02; E21B 31/20; E21B 31/00

See application file for complete search history.

(56) References Cited

U.S. PATENT DOCUMENTS

| | | | | |
|---|---|---|---|---|
| 3,071,192 | A * | 1/1963 | Raulins | E21B 23/02 166/217 |
| 8,201,623 | B2 * | 6/2012 | O'Brien | E21B 47/09 166/237 |
| 8,408,307 | B2 * | 4/2013 | Telfer | E21B 21/103 166/170 |
| 8,567,501 | B2 * | 10/2013 | Zimmerman | E21B 34/14 166/177.5 |
| 2017/0175488 | A1 * | 6/2017 | Lisowski | E21B 34/14 |

* cited by examiner

*Primary Examiner* — Michael R Wills, III

(57) ABSTRACT

A downhole tool includes a deactivation member, a latching member, a release member, and a biasing member. The deactivation member includes an outer protrusion. The latching member is positioned radially-outward from the deactivation member. The latching member includes an inner protrusion and an outer protrusion. The release member includes a sleeve extending axially toward the outer protrusion of the latching member. The biasing member exerts an axial force on the latching member.

20 Claims, 5 Drawing Sheets

DOWNHOLE SHIFTING TOOL

BACKGROUND

A shifting tool is a type of downhole tool that may be used to shift one or more sleeves in a wellbore. For example, a completion assembly positioned within the wellbore may include a plurality of sleeves that are axially-offset from one another. The downhole tool may be run inside the completion assembly, and an engagement member (e.g., a collet) on the downhole tool may be used to engage a first of the sleeves. Once engaged, the downhole tool is moved axially to shift the first sleeve from a first position (e.g., closed) to a second position (e.g., open). The engagement member may then disengage the first sleeve, and the downhole tool may be moved axially until the engagement member engages a second of the sleeves, where the process may be repeated. In another embodiment, the downhole tool may be moved axially to shift the first sleeve from the second position back to the first position (e.g., after fracturing has occurred), after which time the engagement member may disengage the first sleeve, and the downhole tool may be moved axially until the engagement member engages a second of the sleeves, where the process may be repeated.

If the engagement member is unable to disengage one of the sleeves (e.g., due to debris), the downhole tool may become stuck. Conventional downhole tools include an emergency release that is activated by applying a predetermined (e.g., pulling) force on the downhole tool. When the predetermined force is reached, the emergency release either shears the engagement member, or an internal pin or ring may shear, thereby allowing the downhole tool to disengage the sleeve. The downhole tool is then pulled out of the wellbore to repair or replace the engagement member. The downhole tool is then run back into the wellbore to continue shifting the sleeves. Tripping the downhole tool out of the wellbore and then back into the wellbore is a time-consuming process.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool is disclosed. The downhole tool includes a deactivation member, a latching member, a release member, and a biasing member. The deactivation member includes an outer protrusion. The latching member is positioned radially-outward from the deactivation member. The latching member includes an inner protrusion and an outer protrusion. The release member includes a sleeve extending axially toward the outer protrusion of the latching member. The biasing member exerts an axial force on the latching member.

In another embodiment, the downhole tool includes a deactivation member, a latching member, a release member, a first biasing member, and a second biasing member. The deactivation member includes a first outer protrusion and a second outer protrusion. The latching member is positioned radially-outward from the deactivation member. The latching member includes a first inner protrusion, a second inner protrusion, a first outer protrusion, and a second outer protrusion. The release member includes a first sleeve extending axially-toward the first outer protrusion of the latching member and a second sleeve extending axially-toward the second outer protrusion of the latching member. The first biasing member exerts an axial force on the latching member in a first direction. The second biasing member exerts an axial force on the latching member in a second, opposing direction.

A method for resetting a downhole tool in a wellbore is also disclosed. The method includes engaging an object in the wellbore using a latching member of the downhole tool. The latching member includes an inner protrusion and an outer protrusion. At least a portion of the downhole tool in the wellbore is moved when the object is engaged with the latching member, thereby causing a disengaging member of the downhole tool to move axially with respect to the latching member. The disengaging member is positioned radially-inward from the latching member and includes an outer protrusion. The latching member disengages from the object when the disengaging member moves axially with respect to the latching member.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the system and method disclosed herein may be practiced without these specific details.

Figure 1:
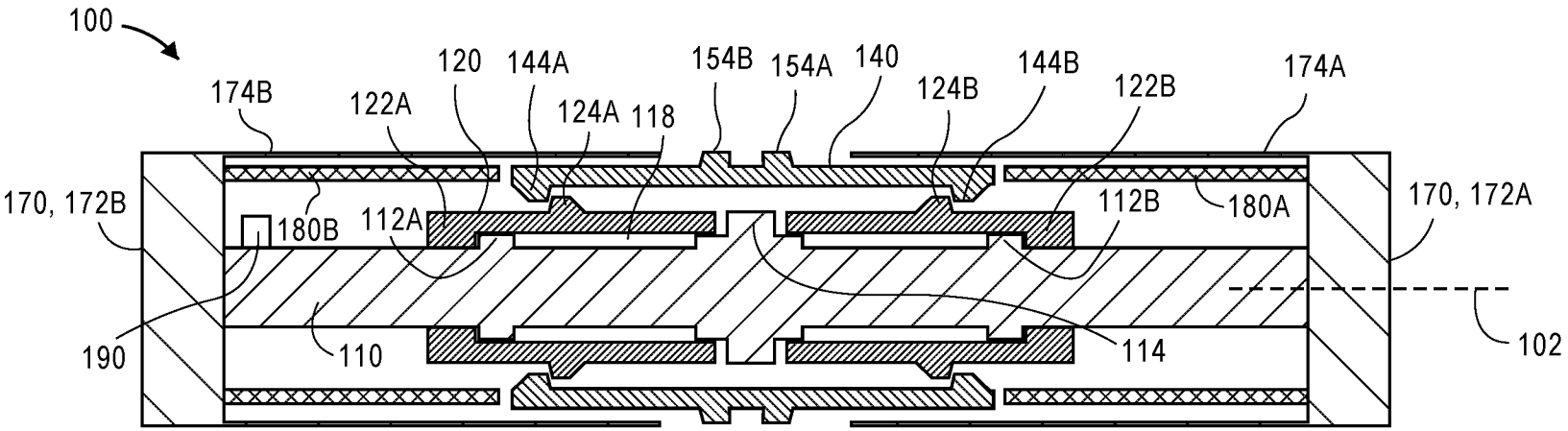
FIG. 1 illustrates a cross-sectional side view of a downhole tool, according to an embodiment.
Figure 2:
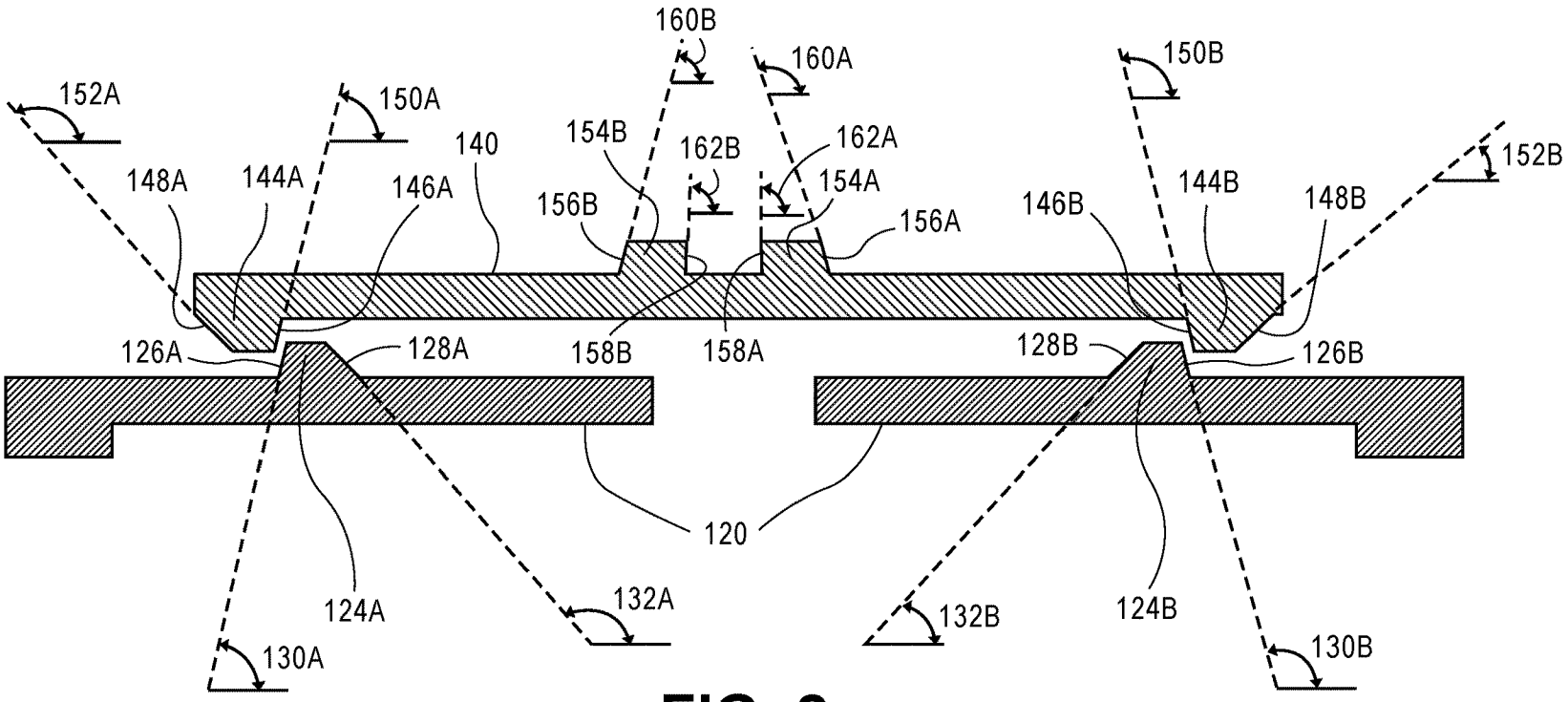
FIG. 2 illustrates an enlarged cross-sectional side view of a portion of the downhole tool showing a disengaging member and a latching member, according to an embodiment.

FIG. 1 illustrates a cross-sectional side view of a downhole tool 100, and FIG. 2 illustrates an enlarged cross-sectional side view of a portion of the downhole tool 100, according to an embodiment. The downhole tool may include a mandrel 110. The mandrel 110 may have an axial bore formed at least partially therethrough. The mandrel 110 may include one or more outer protrusions (three are shown: 112A, 112B, 114) extending radially-outward therefrom. In other embodiments, the mandrel 110 may also or instead include one or more recesses formed radially-therein.

The downhole tool 100 may also include a deactivation member 120 that is coupled to or integral with the mandrel 110. As shown, the deactivation member 120 may be positioned radially-outward from the mandrel 110. The deactivation member 120 may be or include one or more collets, latches, keys, dogs, lugs, snap rings, or the like. As shown, the deactivation member 120 may include one or more inner protrusions (two are shown: 122A, 122B) extending radially-inward therefrom. The inner protrusions 122A, B of the deactivation member 120 may contact an outer surface of the mandrel 110, forming a recess 118 between the deactivation member 120 and the mandrel 110. The outer protrusions 112A, B of the mandrel 110 may be positioned within the recess 118 and axially-between the inner protrusions 122A, B of the deactivation member 120 to secure the deactivation member 120 axially in place with respect to the mandrel 110.

The deactivation member 120 may also include one or more outer protrusions (two are shown: 124A, 124B) extending radially-outward therefrom. As shown, the outer protrusions 124A, B may be axially-offset from one another. The outer protrusions 124A, B may each include a first (e.g., upper) face 126A, 128B and a second (e.g., lower) face 128A, 126B. The upper face 126A of the first outer protrusion 124A may be oriented at an angle 130A with respect to a central longitudinal axis 102 through the downhole tool 100. The angle 130A may be from about 40° to about 89°, about 60° to about 85°, or about 70° to about 85°. The lower face 128A of the first outer protrusion 124A may be oriented at an angle 132A with respect to the central longitudinal axis 102 through the downhole tool 100. The angle 132A may be from about 100° to about 170°, about 120° to about 150°, or about 130° to about 140°. The angle 130A of the upper face 126A of the first outer protrusion 124A may be steeper (i.e., closer to 90°/perpendicular) with respect to the central longitudinal axis 102 than the angle 132A of the lower face 128A of the first outer protrusion 124A.

The lower and upper faces 126B, 128B of the second outer protrusion 124B may be mirror images of the upper and lower faces 126A, 128A of the first outer protrusion 124A, respectively. For example, the lower face 126B of the second outer protrusion 124B may be oriented at an angle 130B with respect to the central longitudinal axis 102 that is from about 91° to about 140°, about 95° to about 120°, or about 95° to about 110°. The upper face 128B of the second outer protrusion 124B may be oriented at an angle 132B with respect to the central longitudinal axis 102 that is from about 10° to about 80°, about 30° to about 60°, or about 40° to about 50°. The angle 130B of the lower face 126B of the second outer protrusion 124B may be steeper (i.e., closer to 90°/perpendicular) with respect to the central longitudinal axis 102 than the angle 132B of the upper face 128B of the second outer protrusion 124B.

The downhole tool 100 may also include a latching member 140 that is positioned radially-outward from the deactivation member 120. The latching member 140 may be or include one or more collets, latches, keys, dogs, lugs, snap rings, or the like. As shown, the latching member 140 may include one or more inner protrusions (two are shown: 144A, 144B) extending radially-inward therefrom. As shown, the inner protrusions 144A, B may be axially-offset from one another. The inner protrusions 144A, B of the latching member 140 may at least partially radially-overlap with the outer protrusions 124A, B of the disengaging member 120. This results in one or more of the inner protrusions 144A, B of the latching member 140 contacting one or more of the outer protrusions 124A, B of the disengaging member 120 when the latching member 140 moves axially with respect to the disengaging member 120, as discussed below. In addition, an axial distance between the inner protrusions 144A, B of the latching member 140 may be greater than an axial distance between the outer protrusions 124A, B of the deactivation member 120. This may allow the outer protrusions 124A, B of the deactivation member 120 to be positioned axially-between the inner protrusions 144A, B of the latching member 140 when the downhole tool 100 is in a first position, as shown in FIG. 1.

The inner protrusions 144A, B of the latching member 140 may each include a first (e.g., lower) face 146A, 148B and a second (e.g., upper) face 148A, 146B. The lower face 146A of the first inner protrusion 144A may be oriented at substantially the same angle as the upper face 126A of the first outer protrusion 124A of the disengaging member 120. For example, the lower face 146A of the first inner protrusion 144A may be oriented at an angle 150A with respect to the central longitudinal axis 102 that is from about 40° to about 89°, about 60° to about 85°, or about 70° to about 85°. The upper face 148A of the first inner protrusion 144A may be oriented at substantially the same angle as the lower face 128A of the first outer protrusion 124A of the disengaging member 120. For example, the upper face 148A of the first inner 144A may be oriented at an angle 152A with respect to the central longitudinal axis 102 that is from about 100° to about 170°, about 120° to about 150°, or about 130° to about 140°. The angle 150A of the lower face 146A of the first inner protrusion 144A may be steeper (i.e., closer to 90°/perpendicular) with respect to the central longitudinal axis 102 than the angle 152A of the upper face 148A of the first inner protrusion 144A.

The upper and lower faces 146B, 148B of the second inner protrusion 144B may be a mirror image of the lower and upper faces 146A, 148A of the first inner protrusion 144A, respectively. For example, the upper face 146B of the second inner protrusion 144B may be oriented at an angle 150B with respect to the central longitudinal axis 102 that is from about 91° to about 140°, about 95° to about 120°, or about 95° to about 110°. The outer face 148B of the second inner protrusion 144B may be oriented at an angle 152B with respect to the central longitudinal axis 102 that is from about 10° to about 80°, about 30° to about 60°, or about 40° to about 50°. The angle 150B of the inner face 146B of the second inner protrusion 144B may be steeper (i.e., closer to 90°/perpendicular) with respect to the central longitudinal axis 102 than the angle 152B of the outer face 148B of the second inner protrusion 144B.

The latching member 140 may also include one or more outer protrusions (two are shown: 154A, 154B) extending radially-outward therefrom. As shown, the outer protrusions 154A, B may be axially-offset from one another. The outer protrusions 154A, B may each include a first, lower face 156A, 158B and a second, upper face 156B, 158A. The lower face 156A of the first outer protrusion 154A may be oriented at an angle 160A with respect to the central longitudinal axis 102 through the downhole tool 100 that is from about 90° to about 120°, about 91° to about 110°, or about 95° to about 100°. The upper face 158A of the first outer protrusion 154A may be oriented at an angle 162A with respect to the central longitudinal axis 102 through the downhole tool 100 that is from about 60° to about 120°, about 70° to about 110°, or about 80° to about 100°.

The upper and lower faces 156B, 158B of the second outer protrusion 154B may be mirror images of the lower and upper faces 156A, 158A of the first outer protrusion 154A, respectively. For example, the upper face 156B of the second outer protrusion 154B may be oriented at an angle 160B with respect to the central longitudinal axis 102 that is from about 60° to about 90°, about 70° to about 89°, or about 80° to about 85°. The lower face 158B of the second outer protrusion 154B may be oriented at an angle 162B with respect to the central longitudinal axis 102 that is from about 60° to about 120°, about 70° to about 110°, or about 80° to about 100°.

The downhole tool 100 may also include a release member 170. The release member 170 may include one or more bases (two are shown: 172A, 172B). The deactivation member 120 and the latching member 140 may be positioned axially-between the first and second bases 172A, B of the release member 170. The release member 170 may also include one or more sleeves 174A, 174B extending axially-therefrom. More particularly, the first base 172A may include a first sleeve 174A that extends axially toward the first outer protrusion 154A of the latching member 140, and the second base 172B may include a second sleeve 174B that extends axially toward the second outer protrusion 154B of the latching member 140. Thus, the first and second sleeves 174A, B may extend from the first and second bases 172A, B, respectively, toward one another.

The first and second sleeves 174A, B may be positioned radially-outward from the deactivation member 120 and at least a portion of the latching member 140. However, the first and second sleeves 174A, B may be axially-aligned with the outer protrusions 154A, B of the latching member 140 when the downhole tool 100 is in the first position, as shown in FIG. 1. Although not shown, in at least one embodiment, an end of the first sleeve 174A may have a face that is oriented at substantially the same angle 160A as the outer face 156A of the first outer protrusion 154A of the latching member 140, and an end of the second sleeve 174B may have a face that is oriented at substantially the same angle 160B as the outer face 156B of the second outer protrusion 154B of the latching member 140.

The downhole tool 100 may also include one or more biasing members (two are shown: 180A, 180B). In one example, the biasing members 180A, B may be springs (e.g., coil springs, fluid springs, gas springs, etc.). In another example, the biasing members 180A, B may be or include one or more motors and/or linear actuators. In yet another example, the biasing members 180A, B may be or include a chamber filled with fluid. The chamber may have an orifice and/or a check valve coupled thereto or disposed therein. A pump may be used to transfer the fluid back into the chamber after the downhole tool 100 is reset into the first position.

The biasing members 180A, B may be positioned radially-between the mandrel 110 and the sleeves 174A, B of the release member 170. The biasing members 180A, B may be positioned axially-between the bases 172A, B of the release member 170 and the latching member 140. More particularly, the first biasing member 180A may be positioned axially-between the first base 172A of the release member 170 and the latching member 140, and the second biasing member 180B may be positioned axially-between the second base 172B of the release member 170 and the latching member 140. The biasing members 180A, B may be axially-aligned with the latching member 140. The biasing members 180A, B may be configured to exert an axial force on the latching member 140, as described in greater detail below.

In at least one embodiment, the downhole tool 100 may include a counter 190 that is configured to count the number of times that the downhole tool 100 actuates from the first position to a second position and back to the first position, from the first position to a third position and back to the first position, or a combination thereof, as described in greater detail below. The counter 190 may be coupled to the mandrel 110, the disengaging member 120, the latching member 140, the release member 170, or another component in the downhole tool 100. The counter may be or include a J-slot mechanism, a proximity sensor, or the like.

Figure 3:
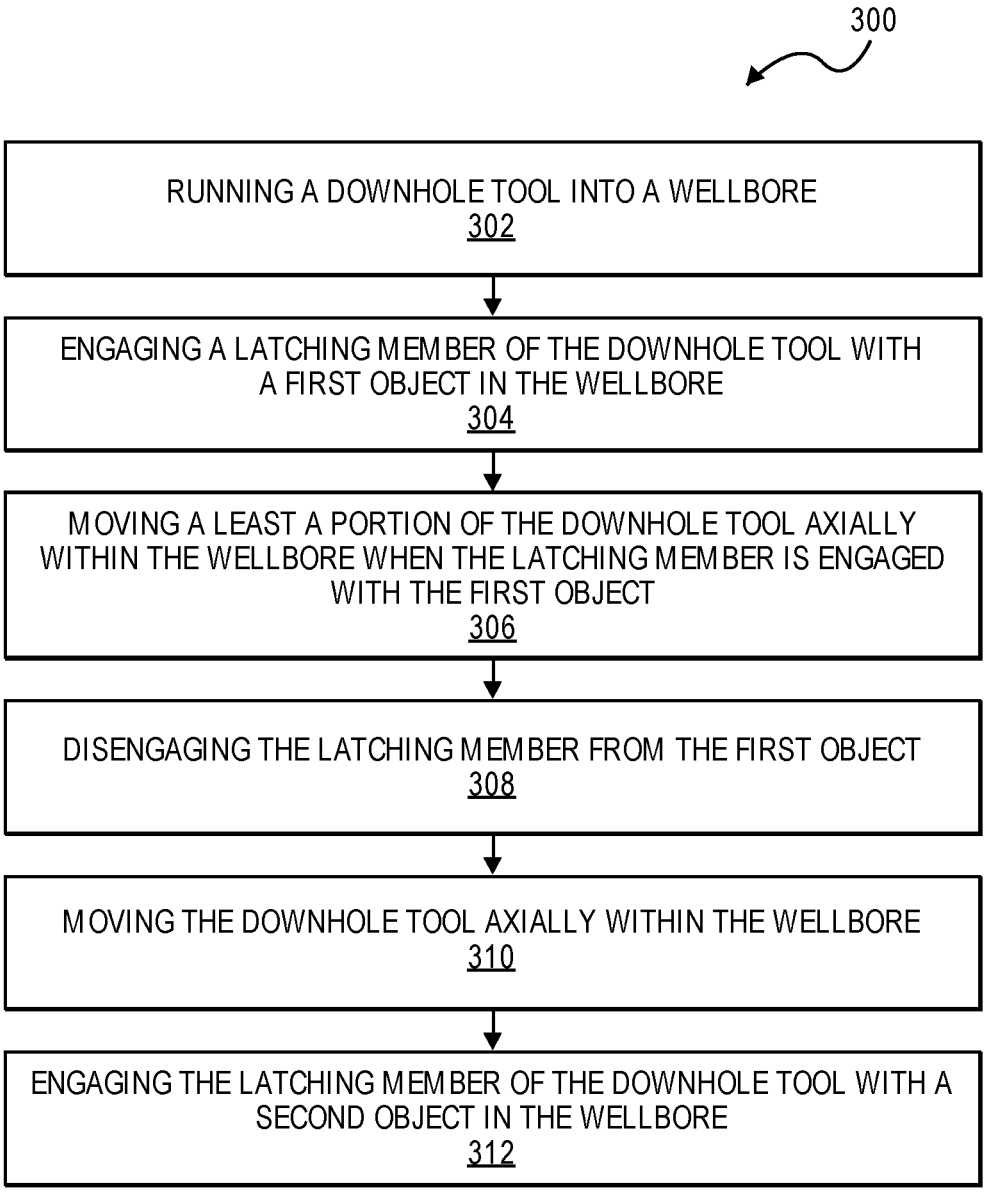
FIG. 3 illustrates a flowchart of a method for resetting the downhole tool in a wellbore, according to an embodiment.
Figure 4:
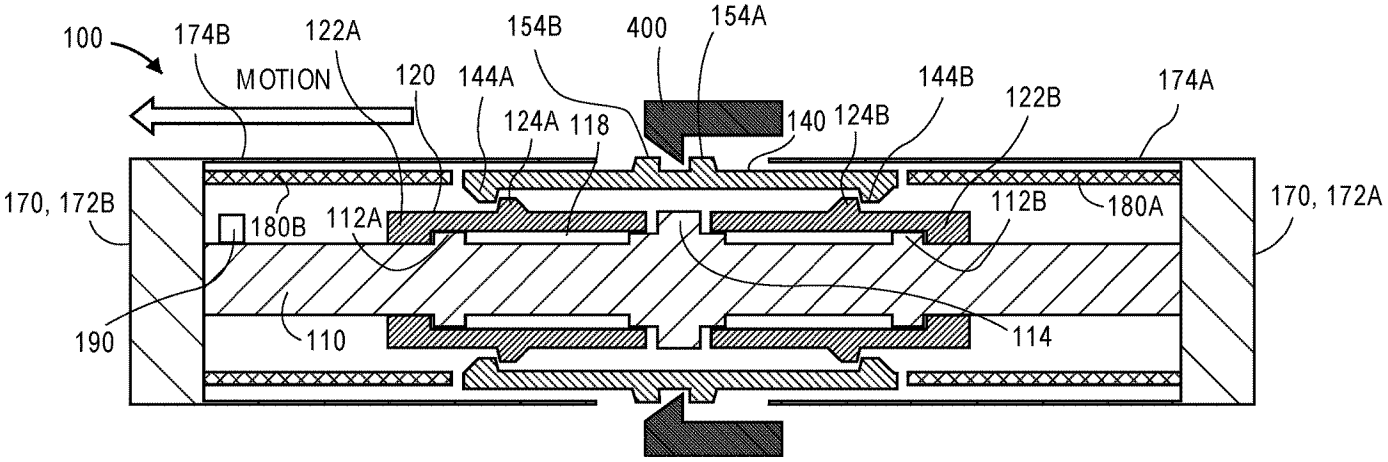
FIG. 4 illustrates a cross-sectional side view of the downhole tool in a first position with the latching member engaged with an object (e.g., a sleeve), according to an embodiment.
Figure 5:
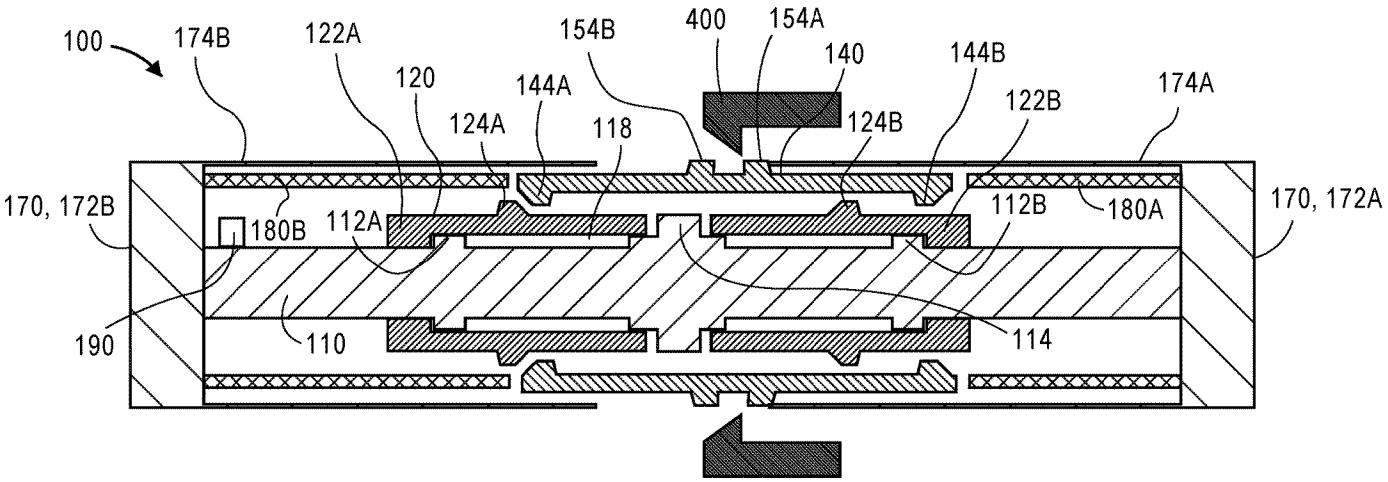
FIG. 5 illustrates a cross-sectional side view of the downhole tool actuating from the first position to a second position to disengage the latching member from the object, according to an embodiment.
Figure 6:
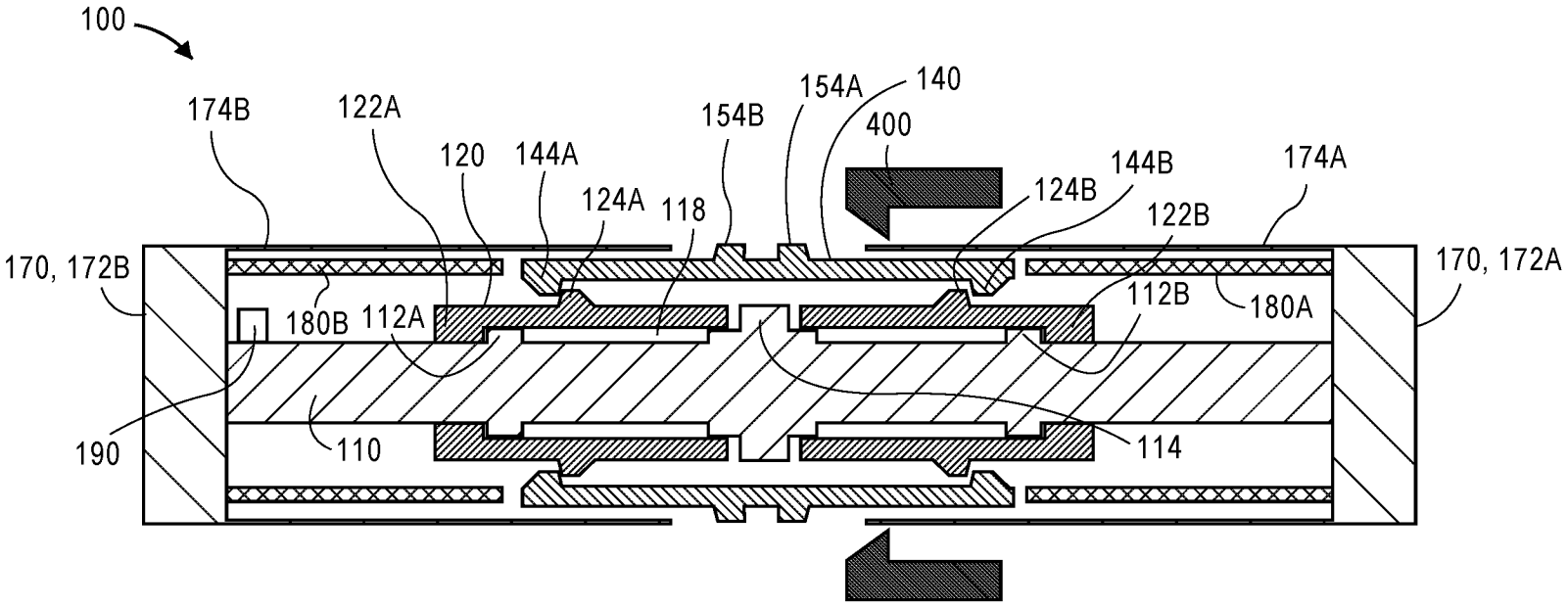
FIG. 6 illustrates a cross-sectional side view of the downhole tool actuating from the second position back into the first position after the latching member has disengaged from the object, according to an embodiment.

FIG. 3 illustrates a flowchart of a method 300 for resetting the downhole tool 100 in a wellbore, according to an embodiment. FIGS. 4-6 illustrate various stages of the method 300. Therefore, FIGS. 4-6 may be viewed together with FIG. 3. The method 300 may begin by running the downhole tool 100 into a wellbore, as at 302. As shown in FIG. 4, the downhole tool 100 may be in the first position when the downhole tool 100 is run into the wellbore. When the downhole tool 100 is in the first position, the lower face 146A of the first inner protrusion 144A of the latching member 140 may be facing the upper face 126A of the first outer protrusion 124A of the deactivation member 120. In addition, the upper face 146B of the second inner protrusion 144B of the latching member 140 may be facing the lower face 126B of the second outer protrusion 124B of the deactivation member 120.

The method 300 may also include engaging the latching member 140 with a first object 400 in the wellbore, as at 304. More particularly, the first object 400 may be engaged by the face 158A of the first outer protrusion 154A of the latching member 140, the face 158B of the second outer protrusion 154B of the latching member 140, or a combination thereof. The first object 400 may be or include a sleeve that is configured to be shifted between two or more positions. In one example, the sleeve may be part of a completion assembly. In other embodiments, the first object 400 may be or include debris in the wellbore.

The method 300 may also include moving at least a portion of the downhole tool 100 axially within the wellbore when the latching member is engaged with the first object 400, as at 306. The downhole tool 100 is shown moving in the uphole direction (i.e., to the left) in FIGS. 4-6. In at least one embodiment, the first object 400 may move together with the downhole tool 100. For example, the first object (e.g., a sleeve) 400 may move from a first (e.g., closed) position to a second (e.g., open) position as the downhole tool 100 moves axially within the wellbore. When the first object 400 moves together with the downhole tool 100, the downhole tool 100 may remain in the first position.

However, in another embodiment, the first object 400 may not move together with the downhole tool 100. In one example, the first object 400 may be a sleeve that is stuck in a first (e.g., closed) position. In another example, the first object 400 may be debris that is stuck in the wellbore. When the first object 400 does not move together with the downhole tool 100, the method 300 may include disengaging the latching member 140 from the first object 400, as at 308. Disengaging the latching member 140 from the first object 400 may include applying a predetermined axial force on the downhole tool 100 (e.g., in the uphole direction), to actuate the downhole tool 100 from the first position (FIG. 4) into a second position (FIG. 5). When actuating from the first position to the second position, the mandrel 110, the deactivation member 120, the release member 170, or a combination thereof move with respect to the latching member 140. As shown in FIG. 5, the mandrel 110, the deactivation member 120, and the release member 170 have moved in the uphole direction (e.g., to the left) while the latching member 140 has remained substantially stationary because it is engaged with the stationary first object 400.

When the downhole tool 100 is in the second position, the upper face 148A of the first inner protrusion 144A of the latching member 140 may be facing the lower face 128A of the first outer protrusion 124A of the deactivation member 120. In addition, the upper face 146B of the second inner protrusion 144B of the latching member 140 may still be facing the lower face 126B of the second outer protrusion 124B of the deactivation member 120.

Moreover, the latching member 140 may move radially-inward when the downhole tool 100 actuates from the first position to the second position. The release member 170 may be placed in contact with the latching member 140 when the downhole tool 100 is in the second position. More particularly, the first sleeve 174A may be placed in contact with the face 156A of the first outer protrusion 154A of the latching member 140 when the downhole tool 100 is in the second position. As the face 156A may be inclined (e.g., at the angle 160A), the contact between the first sleeve 174A and the face 156A of the first outer protrusion 154A of the latching member 140 may push the latching member 140 radially-inward. The latching member 140 may be able to disengage the first object 400 when the latching member 140 moves radially-inward.

The force exerted on the latching member 140 by the first biasing member 180A may increase as the downhole tool 100 actuates from the first position to the second position. For example, the latching member 140 may compress the first biasing member 180A as the downhole tool 100 actuates from the first position to the second position. Once the latching member 140 disengages the first object 400, the force exerted on the latching member 140 by the first biasing member 180A may cause the latching member 140 to move axially with respect to the mandrel 110, the deactivation member 120, the release member 170, or a combination thereof, thereby actuating the downhole tool 100 from the second position back into the first position, as shown in FIG. 6. As the angles 132A, 152A of the lower face 128A of the first outer protrusion 124A of the disengaging member 120 and the upper face 148A of the first inner protrusion 144A of the latching member 140 may be less steep than the angles 130A, 150A of the upper face 126A of the first outer protrusion 124A of the disengaging member 120 and the lower face 146A of the first inner protrusion 144A of the latching member 140, the axial force to actuate the downhole tool 100 from the second position into the first position may be less than the axial force to actuate the downhole tool 100 from the first position into the second position, thereby enabling the downhole 100 to reset itself in the wellbore.

In addition to moving axially with respect to the mandrel 110, the deactivation member 120, the release member 170, or a combination thereof when actuating from the second position back into the first position, the latching member 140 may also move radially-outward again because the first sleeve 174A is no longer bearing on the face 156A of the first outer protrusion 154A of the latching member 140. As a result, the latching member 140 is reset and ready to engage a second object (e.g., sleeve) 400.

After the latching member 140 has disengaged the first object 400, and the downhole tool 100 has actuated back into the first position, the method 300 may then include moving the downhole tool 100 axially within the wellbore, as at 310. For example, the downhole tool 100 may be moved to substantially align the latching member 140 with a second object (not shown). The method 300 may then include engaging the second object in the wellbore with the latching member 140, as at 312. The method 300 may then loop back around to 306 and repeat.

Although the method 300 (and FIGS. 4-6) describe the downhole tool 100 actuating between first and second positions, it will be appreciated that the downhole tool 100 may also be configured to actuate between the first position and a third position. The third position may be a mirror image of the second position. More particularly, rather than being moved in the uphole direction, at least a portion of the downhole tool 100 may also or instead be moved in the downhole direction (e.g., to the right in FIGS. 4-6). If the latching member 140 remains engaged with a stationary object 400, the downhole tool 100 may actuate from the first position into the third position when exposed to a predetermined axial force. When the downhole tool 100 is in the third position, the lower face 148B of the second inner protrusion 144B of the latching member 140 may be facing the upper face 128B of the second outer protrusion 124B of the deactivation member 120. In addition, the lower face 146A of the first inner protrusion 144A of the latching member 140 may be facing the upper face 126A of the first outer protrusion 124A of the deactivation member 120.

Moreover, the latching member 140 moves radially-inward when the downhole tool 100 actuates from the first position to the third position. The release member 170 may be placed in contact with the latching member 140 when the downhole tool 100 is in the third position. More particularly, the second sleeve 174B may be placed in contact with the face 156B of the second outer protrusion 154B of the latching member 140 when the downhole tool 100 is in the third position. As the face 156B may be inclined (e.g., at the angle 160B), the contact between the second sleeve 174B and the face 156B of the second outer protrusion 154B of the latching member 140 may push the latching member 140 radially-inwards. The latching member 140 may be able to disengage the first object 400 when the latching mechanism 140 moves radially-inwards.

The force exerted on the latching member 140 by the second biasing member 180B may increase as the downhole tool 100 actuates from the first position to the third position. For example, the latching member 140 may compress the second biasing member 180B as the downhole tool 100 actuates from the first position to the third position.

Once the latching member 140 disengages the first object 400, the force exerted on the latching member 140 by the second biasing member 180B may cause the latching member 140 to move with respect to the mandrel 110, the deactivation member 120, the release member 170, or a combination thereof, thereby actuating the downhole tool 100 from the third position back into the first position.

In addition to moving axially with respect to the mandrel 110, the deactivation member 120, the release member 170, or a combination thereof when actuating from the third position back into the first position, the latching member 140 may also move radially-outward again because the second sleeve 174B is no longer bearing on the face 156B of the second outer protrusion 154B of the latching member 140. As a result, the latching member 140 is ready again to engage a second object (e.g., sleeve) 400.

Thus, as will be appreciated, the downhole tool 100 may be configured to reset itself when moving in one axial direction downhole or both axial directions downhole. Moreover, the angles 130A, 130B, 132A, 132B, 150A, 150B, 152A, 152B, 160A, 160B and/or the biasing members 180A, B may be tailored to modify the forces that actuate the downhole tool 100 between the various positions.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A downhole tool, comprising:

a deactivation member comprising an outer protrusion;

a latching member positioned radially-outward from the deactivation member, wherein the latching member comprises an inner protrusion and an outer protrusion;

a release member comprising a sleeve extending axially toward the outer protrusion of the latching member; and a biasing member configured to exert an axial force on the latching member.

2. The downhole tool of claim 1, wherein the latching member is configured to move from a first position to a second position with respect to the deactivation member, wherein the inner protrusion of the latching member is on a first side of the outer protrusion of the deactivation member when the latching member is in the first position, and wherein the inner protrusion of the latching member is on a second side of the outer protrusion of the deactivation member when the latching member is in the second position.

3. The downhole tool of claim 2, wherein the axial force exerted on the latching member is greater when the latching member is in the second position than when the latching member is in the first position.

4. The downhole tool of claim 3, wherein the axial force pushes the latching member toward the first position.

5. The downhole tool of claim 2, wherein the outer protrusion of the deactivation member comprises a first face that faces a first face of the inner protrusion of the latching member when the latching member is in the first position, and wherein the first face of the outer protrusion of the deactivation member is oriented at a first angle with respect to a central longitudinal axis through the downhole tool.

6. The downhole tool of claim 5, wherein the outer protrusion of the deactivation member comprises a second face that faces a second face of the inner protrusion of the latching member when the latching member is in the second position, wherein the second face of the outer protrusion of the deactivation member is oriented at a second angle with respect to the central longitudinal axis through the downhole tool, and wherein the first angle is closer to 90° than the second angle.

7. The downhole tool of claim 6, wherein the first face of the inner protrusion of the latching member is oriented at a third angle with respect to the central longitudinal axis through the downhole tool, wherein the second face of the inner protrusion of the latching member is oriented at a fourth angle with respect to the central longitudinal axis through the downhole tool, and wherein the third angle is closer to 90° than the fourth angle.

8. The downhole tool of claim 2, wherein the sleeve is not in contact with the outer protrusion of the latching member when the latching member is in the first position, and wherein the sleeve is in contact with the outer protrusion of the latching member when the latching member is in the second position.

9. The downhole tool of claim 8, wherein the sleeve causes the latching member to move radially-inward when the sleeve is in contact with the outer protrusion of the latching member.

10. The downhole tool of claim 9, wherein the outer protrusion of the latching member comprises a face that faces the sleeve, and wherein the face is oriented at an angle with respect to a central longitudinal axis through the downhole tool that causes the latching member to move radially-inward when the sleeve is in contact with the outer protrusion of the latching member.

11. A downhole tool, comprising:

a deactivation member comprising:

a first outer protrusion; and a second outer protrusion;

a latching member positioned radially-outward from the deactivation member, wherein the latching member comprises:

a first inner protrusion;

a second inner protrusion;

a first outer protrusion; and a second outer protrusion;

a release member comprising:

a first sleeve extending axially-toward the first outer protrusion of the latching member; and a second sleeve extending axially-toward the second outer protrusion of the latching member;

a first biasing member configured to exert an axial force on the latching member in a first direction; and a second biasing member configured to exert an axial force on the latching member in a second, opposing direction.

12. The downhole tool of claim 11, wherein the latching member is configured to move from a first position to a second position with respect to the deactivation member, wherein the first inner protrusion of the latching member is on a first side of the first outer protrusion of the deactivation member when the latching member is in the first position, and wherein the first inner protrusion of the latching member is on a second side of the first outer protrusion of the deactivation member when the latching member is in the second position.

13. The downhole tool of claim 12, wherein the second inner protrusion of the latching member remains on a first side of the second outer protrusion of the deactivation member when the latching member is in the first and second positions.

14. The downhole tool of claim 13, wherein the latching member is configured to move from the first position to a third position with respect to the deactivation member, wherein the second inner protrusion of the latching member is on a second side of the second outer protrusion of the deactivation member when the latching member is in the third position, and wherein the first inner protrusion of the latching member remains on the first side of the first outer protrusion of the deactivation member when the latching member is in the first and third positions.

15. The downhole tool of claim 14, wherein the first outer protrusion of the deactivation member comprises a first face and a second face, wherein the first face faces the first inner protrusion of the latching member when the latching member is in the first position, wherein the second face faces the first inner protrusion of the latching member when the latching member is in the second position, and wherein the first face is closer to 90° than the second face with respect to a central longitudinal axis through the downhole tool.

16. A method for resetting a downhole tool in a wellbore, comprising:

engaging an object in the wellbore using a latching member of the downhole tool, wherein the latching member comprises an inner protrusion and an outer protrusion;

moving at least a portion of the downhole tool in the wellbore when the object is engaged with the latching member, thereby causing a disengaging member of the downhole tool to move axially with respect to the latching member, wherein the disengaging member is positioned radially-inward from the latching member and comprises an outer protrusion; and disengaging the latching member from the object when the disengaging member moves axially with respect to the latching member, wherein a release member comprising a sleeve extends axially toward the outer protrusion of the latching member, and wherein a biasing member is configured to exert an axial force on the latching member.

17. The method of claim 16, wherein the latching member moves from a first position to a second position with respect to the disengaging member to cause the latching member to disengage the object, wherein the inner protrusion of the latching member is on a first side of the outer protrusion of the disengaging member when the latching member is in the first position, and wherein the inner protrusion of the latching member is on a second side of the outer protrusion of the disengaging member when the latching member is in the second position.

18. The method of claim 17, wherein the latching member moves radially-inward when the latching member moves from the first position to the second position, and wherein the object disengages from the latching member in response to the latching member moving radially-inward.

19. The method of claim 18, wherein the axial force exerted on the latching member by the biasing member increases when the latching member moves from the first position to the second position, and wherein the axial force pushes the latching member toward the first position.

20. The method of claim 19, wherein the axial force moves the latching member from the second position back to the first position after the latching member disengages the object.

* * * * *